US007138883B2

(12) United States Patent
Takano

(10) Patent No.: US 7,138,883 B2
(45) Date of Patent: Nov. 21, 2006

(54) NON-RECIPROCAL CIRCUIT ELEMENT

(75) Inventor: Atsuo Takano, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 115 days.

(21) Appl. No.: 11/061,502

(22) Filed: Feb. 17, 2005

(65) Prior Publication Data

US 2005/0190008 A1 Sep. 1, 2005

(30) Foreign Application Priority Data

Feb. 26, 2004 (JP) ..... 2004-051482

(51) Int. Cl.
*H01P 1/38* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS 6,765,453 B1 7/2004 Yamaguchi et al.

FOREIGN PATENT DOCUMENTS

JP 11-298207 10/1999
JP 2003-347807 * 5/2003

* cited by examiner

*Primary Examiner*—Stephen E. Jones
(74) *Attorney, Agent, or Firm*—Brinks Hofer Gilson & Lione

(57) ABSTRACT

In a non-reciprocal circuit element, capacitors are disposed on a bottom surface of a dielectric facing a ferrite member in a state in which first electrodes are connected to port portions serving as one end of central conductors, and second electrodes of the capacitors and ground portions serving as the other ends of the central conductors are connected to a ground plate composed of one sheet of metal plate and the ground plate is connected to a lower plate of a second yoke. Therefore, by means of the ground plate made of one sheet of metal plate, the second electrodes of the capacitors and the ground portions of the central conductors can be connected to ground.

9 Claims, 8 Drawing Sheets

NON-RECIPROCAL CIRCUIT ELEMENT

This application claims the benefit of priority to Japanese Patent Application No. 2004-051482 filed on Feb. 26, 2004, herein incorporated by reference.

BACKGROUND OF THE INVENTION

1. Field of the Invention

The present invention relates to a non-reciprocal circuit element, such as an isolator or a circulator, which can be applied to a transmitting unit of a mobile communication device, such as a cellular phone or the like.

2. Description of the Related Art

FIG. 12 is an exploded perspective view of a conventional non-reciprocal circuit element. Hereinafter, a configuration of the conventional non-reciprocal circuit element will be described with reference to FIG. 12. A first yoke 51 made of a boxlike magnetic plate (iron plate or the like) is boxlike and a magnet 52 having a rectangular shape is attached to the inside of the first yoke 51 by means of a magnetic force or the like.

A second yoke 53 made of a magnetic plate (iron plate or the like) has a lower plate 53*a* and two side plates 53*b* which are bent upward from two opposite sides of the lower plate 53*a*. The second yoke 53 is coupled with the first yoke 51 to form a magnetic closed circuit.

A boxlike resin case 54 made of a synthetic resin molding product has a circular through hole 54*b* provided at a central portion of a lower wall 54*a* and a plurality of concaves 54*c* with bottoms provided around the through hole 54*b*. In addition, the resin case 54 is assembled with the second yoke 53, so that the lower plate 53*a* is exposed to the outside through the through hole 54*b*.

An output terminal 55 and a ground terminal 56 made of metal plates are buried in the resin case 54 to be attached thereto. In addition, the output terminal 55 protrudes toward a sidewall 54*d* in a state in which the output terminal 55 is arranged to be exposed onto the lower wall 54*a* and the ground terminal 56 protrudes toward the sidewall 54*d* in a state in which the ground terminal 56 is exposed onto an inner lower surface of the concave portion 54*c*.

First to third capacitors C1, C2, and C3 are formed of chip type capacitors. While being located into the concave portions 54*c* of the resin case 54, the first to third capacitors C1, C2, and C3 have their lower electrodes (not shown) that are soldered to and mounted on the ground terminal 56 located on the inner lower surfaces of the concave portions 54*c*. Further, a chip type resistor R has one electrode (not shown) that is soldered to and mounted on the ground terminal 56.

A disk-shaped ferrite member 57 made of YIG (Yttrium iron garnet) or the like is inserted into the through hole 54*b* of the resin case 54 in a state in which the disk-shaped ferrite member 57 is located in the through-hole 54*b* of the resin case 54, and a lower surface of the ferrite member 57 is mounted on the lower plate 53*a* of the second yoke 53.

A flat plate-shaped dielectric 58 is composed of a laminated plate obtained by laminating a plurality of insulating thin plates, and first to third central conductors 59, 60, and 61 are disposed at different laminated locations of the dielectric 58 such that parts of them cross each other in a vertical direction.

In addition, the dielectric 58 is mounted on the ferrite member 57, and the first to third central conductors 59, 60, and 61 have port portions connected to upper electrodes of the first to third capacitors C1, C2 and C3 and the output terminal 55 and ground portions of the first to third capacitors C1, C2 and C3 are connected to the ground terminal 56 (for example, see Japanese Unexamined Patent Application Publication NO. 11-298207).

However, the conventional non-reciprocal circuit element need to have the ground terminal 56 buried in the resin case 54 in order to ground the resin case 54 by which the ferrite member 57 and the first to third capacitors C1, C2, and C3 are located and held, the lower electrodes of the capacitors C1, C2, and C3, and the ground portions of the first to third central conductors 59, 60 and 61, and the non-reciprocal circuit element has a large size and many components, which results in increase of cost. In addition, a molding work for burying the output terminal 55 and the ground terminal 56 into the resin case 54 and an assembling work of the second yoke 53 and the resin case 54 are troublesome. As a result, the productivity decreases and the cost increase.

In addition, each of the capacitors C1, C2, and C3 has a thickness thinner than that of the ferrite member 57. Therefore, in a state in which the concave portion 54*c* is lifted, the work for burying the output terminal 55 and the ground terminal 56 into the resin case 54 becomes necessary, so that a metal mold for forming the resin case 54 becomes complicated, thereby increasing the cost.

The conventional art has the following problems. Specifically, since the conventional non-reciprocal circuit element needs to have the ground terminal 56 buried in the resin case 54 in order to ground the resin case 54 by which the ferrite member 57 and the first to third capacitors C1, C2, and C3 are located and held, the lower electrodes of the capacitors C1, C2, and C3 and the ground portions of the first to third central conductors 59, 60 and 61, the non-reciprocal circuit element has a large size and many components, which results in an increase of the cost. In addition, a molding work for burying the output terminal 55 and the ground terminal 56 into the resin case 54 and an assembling work of the second yoke 53 and the resin case 54 are troublesome. As a result, the productivity decreases and the cost increases.

In addition, each of the capacitors C1, C2, and C3 has a thickness thinner than that of the ferrite member 57. Therefore, in a state in which the concave portion 54*c* is lifted, the work for burying the output terminal 55 and the ground terminal 56 into the resin case 54 becomes necessary, so that a metal mold for forming the resin case 54 becomes complicated, thereby increasing the cost.

SUMMARY OF THE INVENTION

Accordingly, it is an object of the present invention to provide a non-reciprocal circuit element which has a small size, superior productivity and a low cost.

In order to solve the above-mentioned problems, according to a first aspect of the present invention, there is provided a non-reciprocal circuit element comprising: a first yoke having an upper plate; a magnet disposed on a lower surface of the upper plate; a second yoke which has a flat plate-shaped lower plate and which forms a magnetic closed circuit together with the first yoke; a flat plate-shaped ferrite member disposed on the lower plate; a flat plate-shaped dielectric disposed on the ferrite member between the magnet and the ferrite member and which is made of a laminated plate having a plurality of laminated insulating thin plates; first to third central conductors which are formed at different laminated locations of the dielectric and which are disposed in a manner that parts of the first to third central conductors cross each other in a vertical direction; and a plurality of capacitors each having first and second electrodes with an insulating body interposed therebetween, wherein the capacitors are disposed on a bottom surface of the dielectric facing the ferrite member in a state in which the first electrodes are connected to the port portions serving as one end of the central conductors, the second electrodes of the capacitors and ground portions serving as the other ends of the central conductors are connected to a ground plate composed of one sheet of metal plate, and the ground plate is connected to the lower plate of the second yoke.

According to a second aspect of the present invention, on the bottom surface of the dielectric, first land portions connected to the port portions of the central conductors are provided, and the first electrodes are connected to the first land portions.

According to a third aspect of the present invention, the ground plate has a flat plate-shaped base portion and protruding pieces protruding upward from the base portion, the base portion is disposed on the lower plate, and the protruding pieces are connected to the ground portions of the central conductors.

According to a fourth aspect of the present invention, the ground portions of the central conductors lead into through holes or concave portions provided in the dielectric by means of connection conductors, and the protruding pieces are connected to the connection conductors in a state in which the protruding pieces are located in the through holes or concave portions.

According to a fifth aspect of the present invention, the ground plate has flat plate-shaped tongue pieces which are formed to be bent from an outer circumferential portions of the base portion toward the dielectric and which are arranged parallel to a bottom surface of the dielectric, and the tongue pieces are connected to the second electrodes.

According to a sixth aspect of the present invention, a hole is formed in a central portion of the base portion of the ground plate and the ferrite member is disposed on the lower plate through the hole. Further, according to a seventh aspect of the present invention, the ferrite member is disposed on the flat plate-shaped base portion of the ground plate, the ferrite member is interposed between the dielectric and the ground plate, and the ferrite member is connected to the lower plate through the base portion of the ground plate.

Further, according to an eighth aspect of the present invention, the second yoke is integrally formed with a sidewall member composed of an insulating member by means of a molding process, terminal plates are buried in the sidewall member, and the port portions of the central conductors are connected to the terminal plates.

Further, according to a ninth aspect of the present invention, the second yoke has a lower plate, side plates bent upward from the lower plate and concave portions provided in the side plates, a part of the sidewall member is provided in the concave portions, the sidewall member located in the concave portions provided along the side plate is opposite to the electrodes of the capacitors, and the electrodes are electrically insulated from the side plates through the sidewall member.

According to the present invention, the non-reciprocal circuit element comprises a first yoke having an upper plate; a magnet disposed on a lower surface of the upper plate; a second yoke which has a flat plate-shaped lower plate and which forms a magnetic closed circuit together with the first yoke; a flat plate-shaped ferrite member disposed on the lower plate; a flat plate-shaped dielectric disposed on the ferrite member between the magnet and the ferrite member and which is made of a laminated plate having a plurality of laminated insulating thin plates; first to third central conductors which are formed at different laminated locations of the dielectric and which are disposed in a manner that parts of the first to third central conductors cross each other in a vertical direction; and a plurality of capacitors each having first and second electrodes opposite to each other with an insulating body interposed therebetween. The capacitors are disposed on a bottom surface of the dielectric facing the ferrite member in a state in which the first electrodes are connected to the port portions serving as one end of the central conductors, the second electrodes of the capacitors and ground portions serving as the other ends of the central conductors are connected to a ground plate composed of one sheet of metal plate, and the ground plate is connected to the lower plate of the second yoke.

Specifically, the second electrodes of the capacitors and the ground portions of the central conductors are connected to a ground by means of the ground plate made of one sheet of metal plate. Therefore, the non-reciprocal circuit element has the small number of components, a low cost, the superior productivity, the ground plate with the superior space factor and a small size as compared to the conventional non-reciprocal circuit element.

Further, since the conventional molding process is not necessary, the productivity can improved and the cost can be reduced.

Further, on the bottom surface of the dielectric, first land portions connected to the port portions of the central conductors are provided, and the first electrodes are connected to the first land portions. Therefore, the capacitors are easily provided on the bottom surface of the dielectric, so that the assembling can be easily performed.

Further, the ground plate has a flat plate-shaped base portion and protruding pieces protruding upward from the base portion, the base portion is disposed on the lower plate, and the protruding pieces are connected to the ground portions of the central conductors. As a result, since the ground plate can be easily connected to the ground portions of the central conductors, the assembling can be easily performed. Therefore, the ground plate can be easily connected to the lower plate.

Further, the ground portions of the central conductors lead into through holes or concave portions provided in the dielectric by means of connection conductors, and the protruding pieces are connected to the connection conductors in a state in which the protruding pieces are located in the through holes or concave portions. Therefore, the ground plate can be easily connected to the ground portions of the central conductors for sure.

Further, the ground plate has flat plate-shaped tongue pieces which are formed to be bent from outer circumferential portions of the base portion toward the dielectric and which are arranged parallel to a bottom surface of the dielectric, and the tongue pieces are connected to the second electrodes. Therefore, the tongue pieces of the ground plate can be surely connected to the second electrodes.

Further, a hole is formed in a central portion of the base portion of the ground plate and the ferrite member is disposed on the lower plate through the hole. Therefore, the ferrite member can be located by means of the hole, so that the superior assembling can be obtained.

Further, the ferrite member is disposed on the flat plate-shaped base portion of the ground plate, the ferrite member is interposed between the dielectric and the ground plate, and the ferrite member is connected to the lower plate through the base portion of the ground plate. Therefore, the dielectric, capacitors and the ferrite member can be integrally formed on the ground plate, so that the superior assembling can be obtained.

Further, the second yoke is integrally formed with a sidewall member composed of an insulating member by means of a molding process, terminal plates are buried in the sidewall member, and the port portions of the central conductors are connected to the terminal plates. Therefore, the non-reciprocal circuit element can be easily connected to an external device.

Further, the second yoke has a lower plate, side plates bent upward from the lower plate and concave portions provided in the side plates, a part of the sidewall member is provided in the concave portions, the sidewall member located in the concave portions provided along the side plate is opposite to the electrodes of the capacitors, and the electrodes are electrically insulated from the side plates through the sidewall member. Therefore, the thickness of the sidewall member can decrease, the electrodes can be arranged near the side plates and the size of the non-reciprocal circuit element can decrease. In addition, the electrodes of the capacitors can be surely insulated.

DESCRIPTION OF THE PREFERRED EMBODIMENTS

Figure 1:
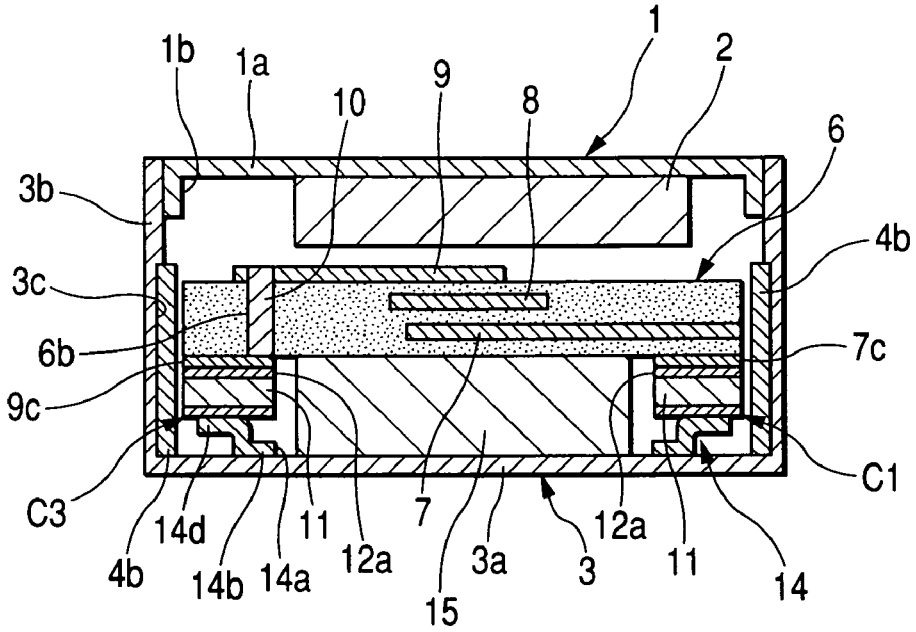
FIG. 1 is a cross-sectional view of essential parts showing a connection structure of a capacitor in a non-reciprocal circuit element according to a first embodiment of the present invention.
Figure 2:
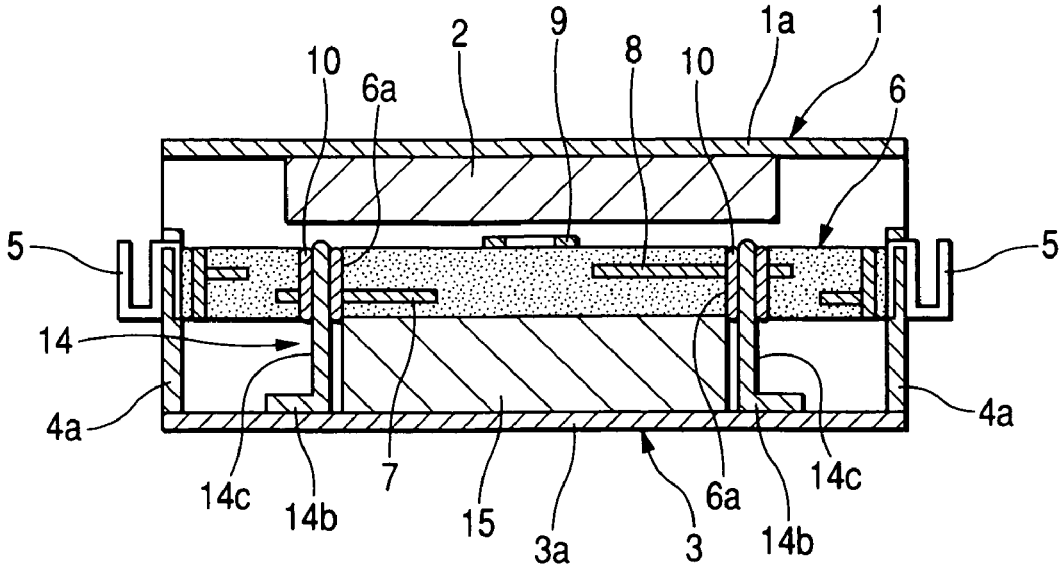
FIG. 2 is a cross-sectional view of essential parts showing connection structures of a ground plate and a terminal plate in a non-reciprocal circuit element according to a first embodiment of the present invention.
Figure 3:
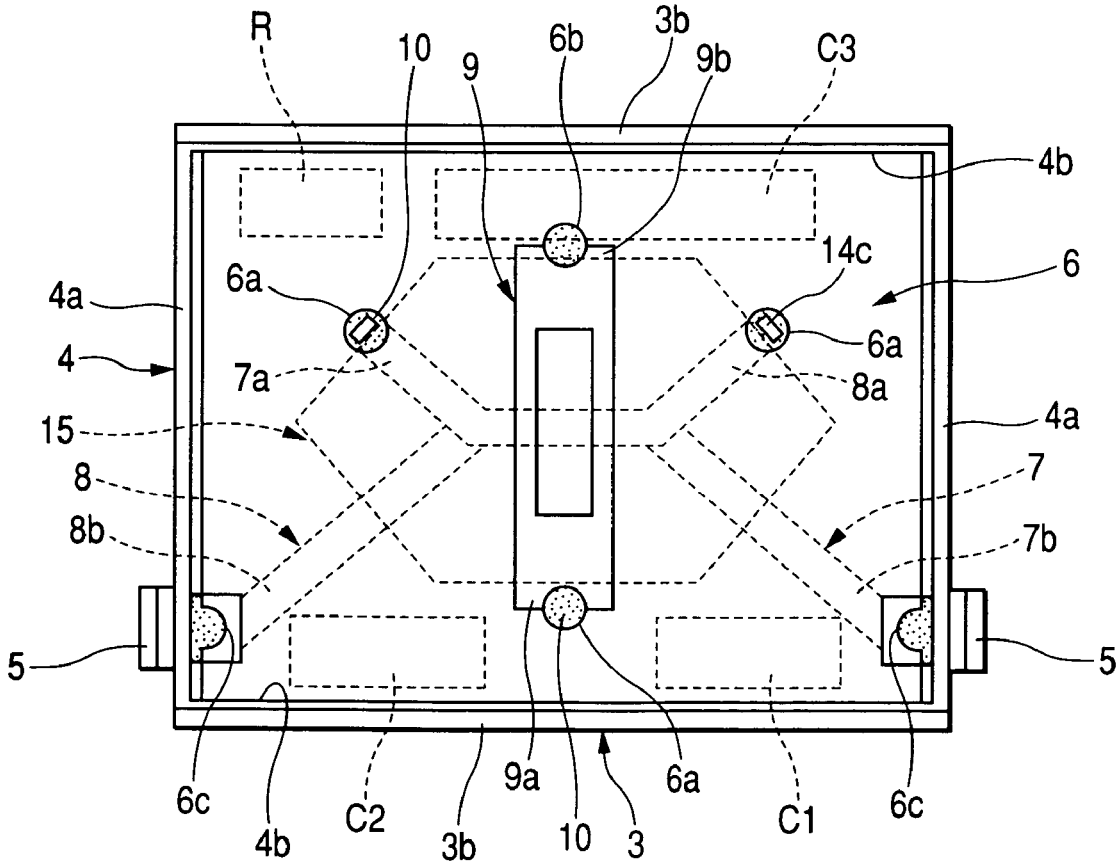
FIG. 3. is a plan view of a non-reciprocal circuit element according to a first embodiment of the present invention in a state in which a first yoke and a magnet are removed therefrom.

A non-reciprocal circuit element of the present invention will be described with reference to the accompanying drawings. FIG. 1 is a cross-sectional view of essential parts showing a connection structure of a capacitor in a non-reciprocal circuit element according to a first embodiment of the present invention; FIG. 2 is a cross-sectional view of essential parts showing connection structures of a ground plate and a terminal plate in the non-reciprocal circuit element according to the first embodiment of the present invention, and FIG. 3 is a plan view of the non-reciprocal circuit element according to the first embodiment of the present invention in a state in which a first yoke and a magnet are removed therefrom.

Figure 4:
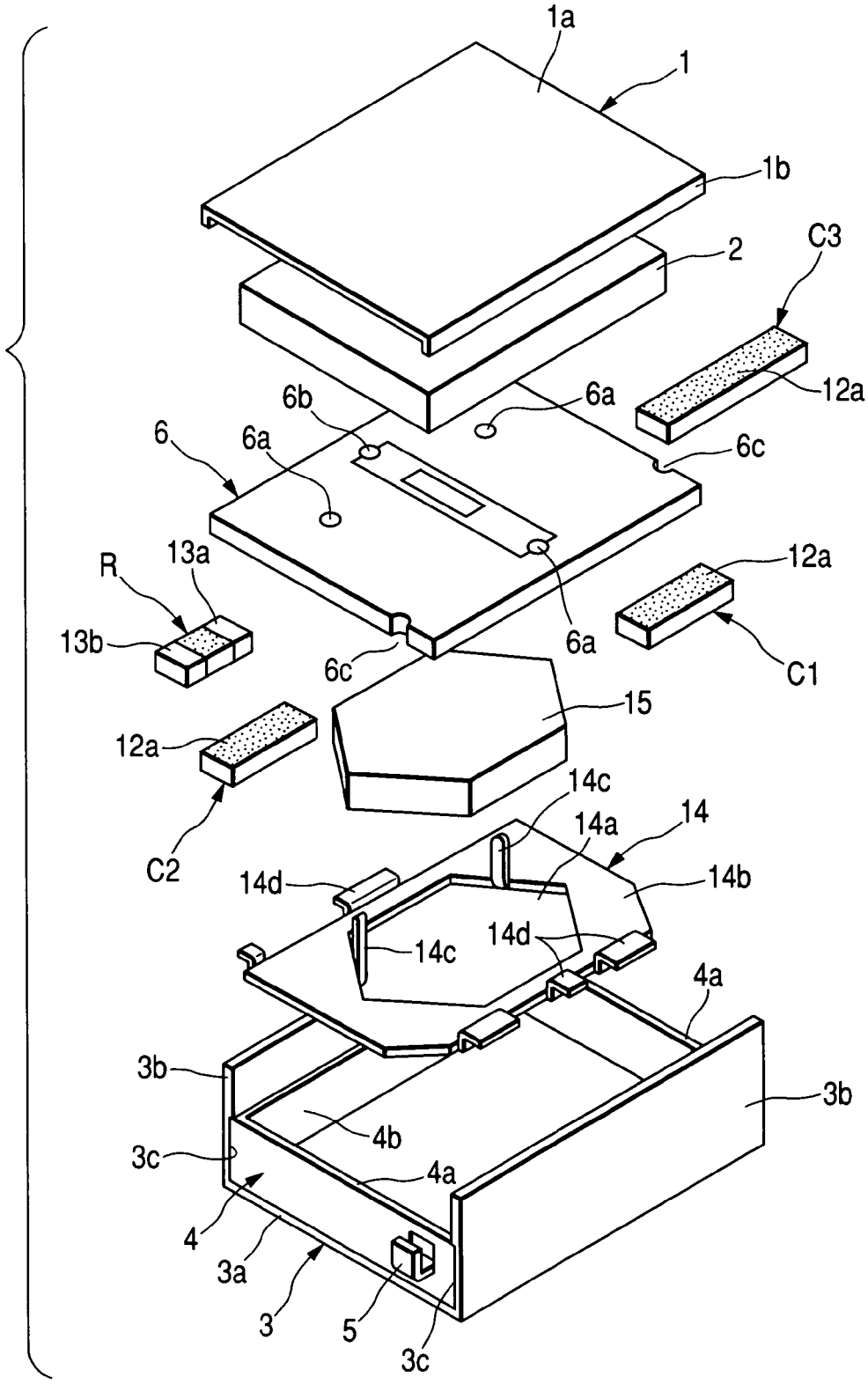
FIG. 4 is an exploded perspective view of a non-reciprocal circuit element according to a first embodiment of the present invention.
Figure 5:
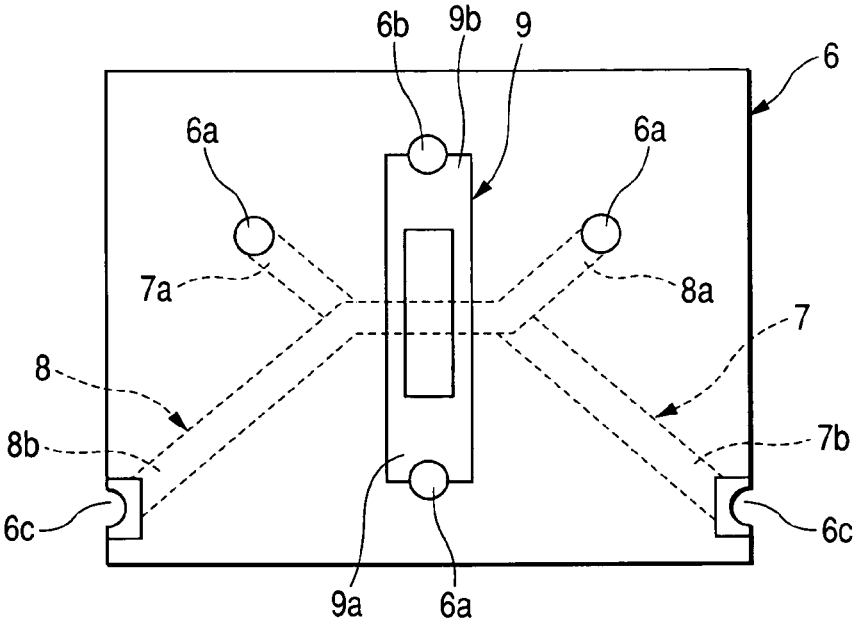
FIG. 5 is a plan view of a dielectric in a non-reciprocal circuit element according to a first embodiment of the present invention.
Figure 6:
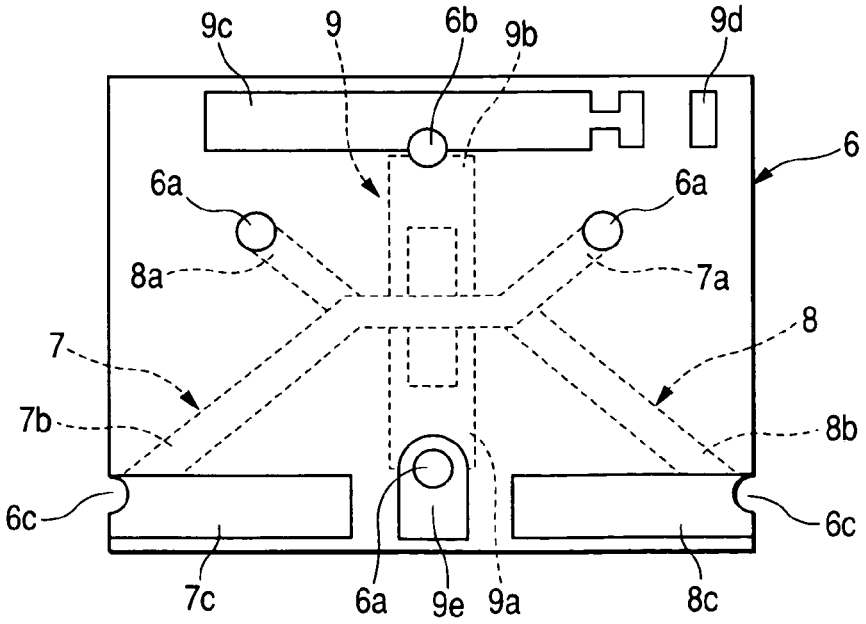
FIG. 6 is a bottom view of a dielectric in a non-reciprocal circuit element according to a first embodiment of the present invention.
Figure 7:
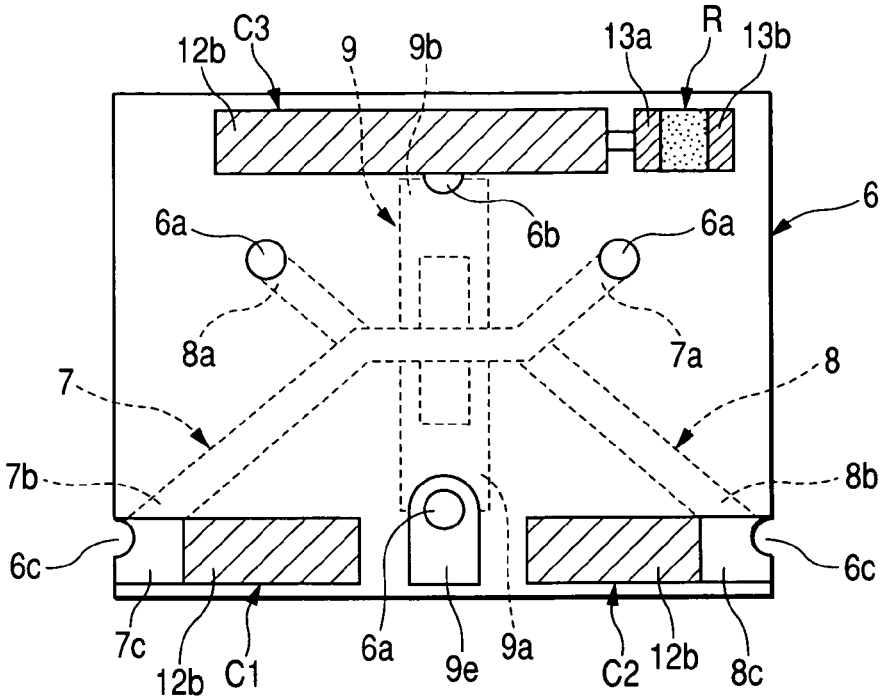
FIG. 7 is a bottom view of a non-reciprocal circuit element according to a first embodiment of the present invention in a state in which a capacitor and a resistor are attached to a dielectric.

Further, FIG. 4 is an exploded perspective view of the non-reciprocal circuit element according to the first embodiment of the present invention; FIG. 5 is a plan view of a dielectric in the non-reciprocal circuit element according to the first embodiment of the present invention; FIG. 6 is a bottom view of the dielectric in the non-reciprocal circuit element according to the first embodiment of the present invention; and FIG. 7 is a bottom view of the non-reciprocal circuit element according to the first embodiment of the present invention in a state in which a capacitor and a resistor are attached to the dielectric.

Figure 8:
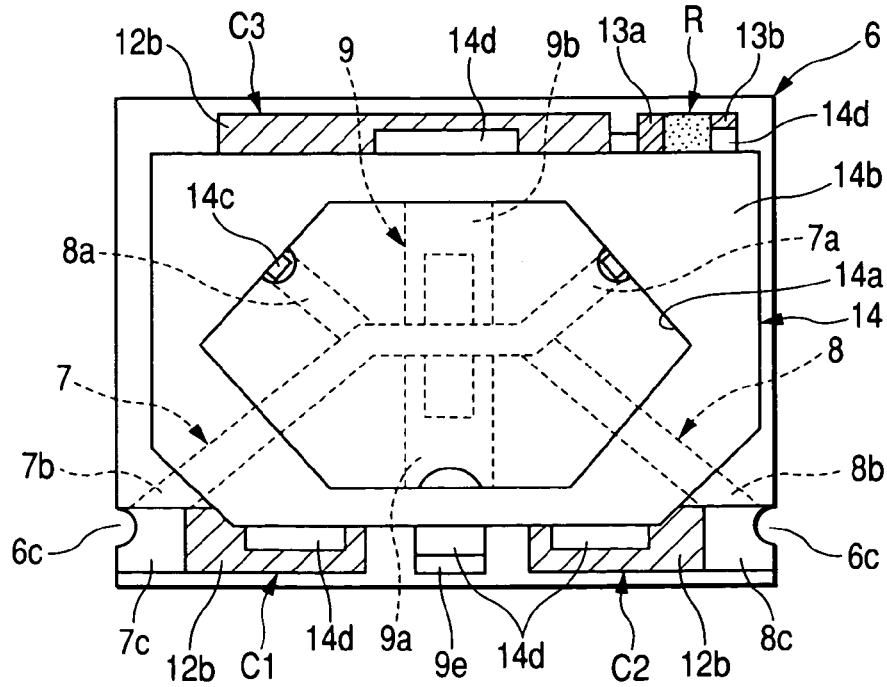
FIG. 8 is a bottom view of a non-reciprocal circuit element according to a first embodiment of the present invention in a state in which a ground plate is attached to a dielectric.
Figure 9:
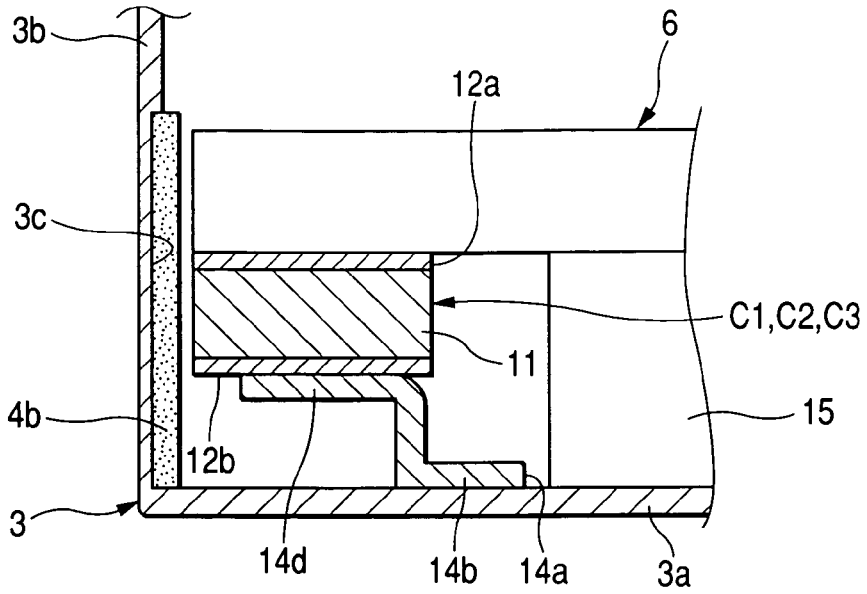
FIG. 9 is an enlarged cross-sectional view of essential parts of a non-reciprocal circuit element according to a first embodiment of the present invention in a state in which a capacitor is attached thereto.
Figure 10:
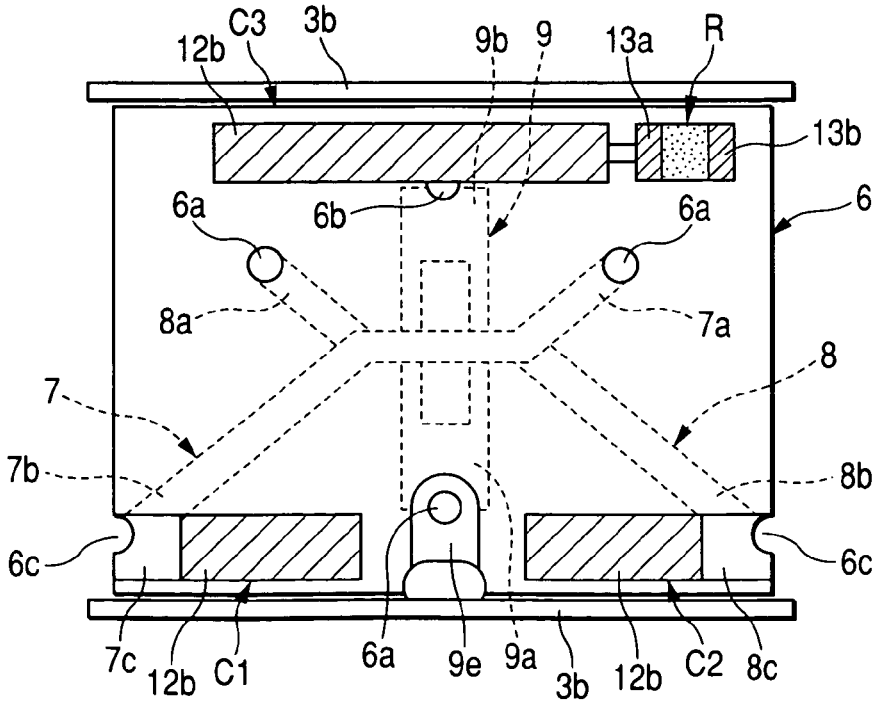
FIG. 10 is a bottom view of a non-reciprocal circuit element according to a second embodiment of the present invention in a state in which a central conductor is connected to a ground.
Figure 11:
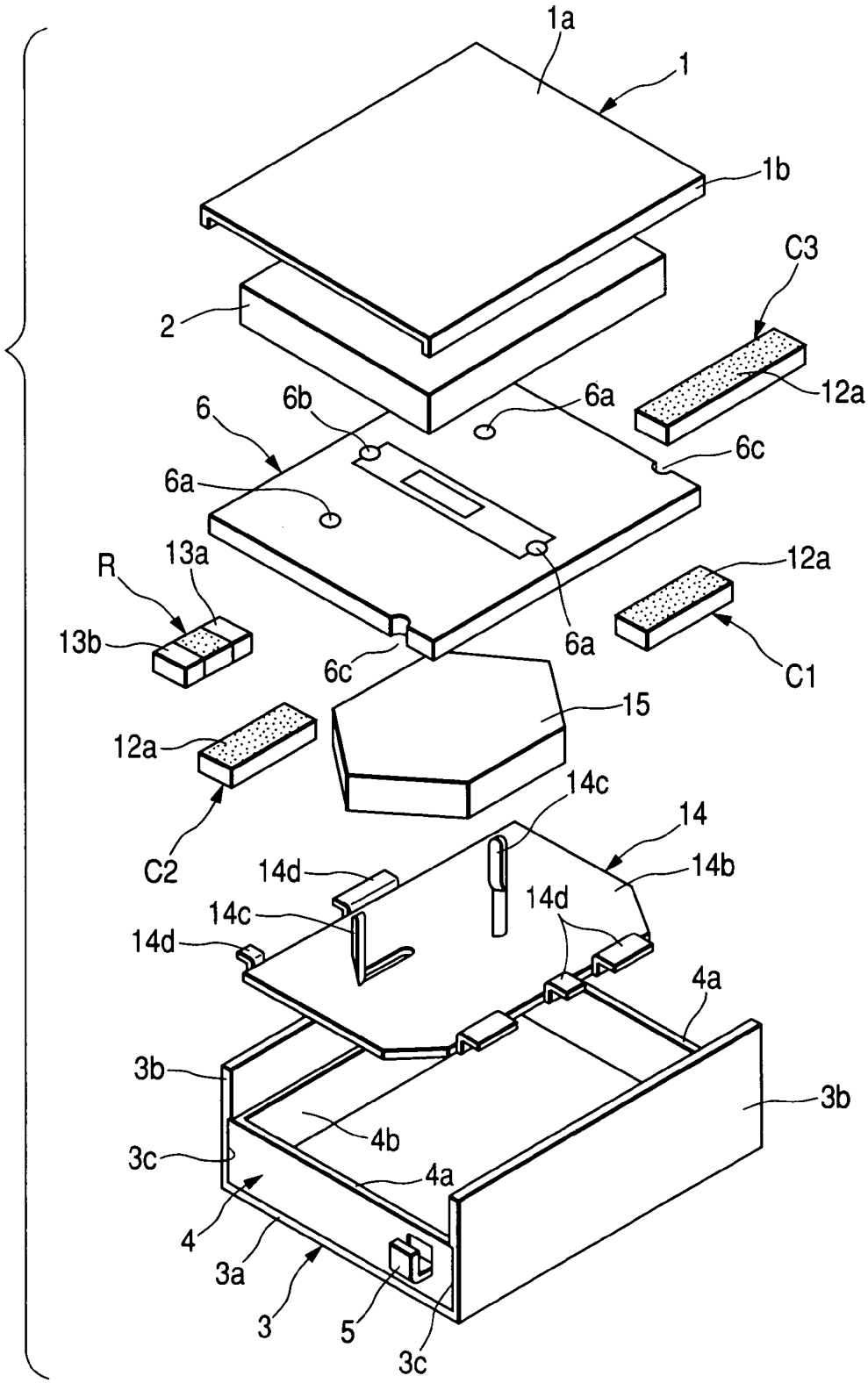
FIG. 11 is an exploded perspective view of a non-reciprocal circuit element according to a third embodiment of the present invention.
Figure 12:
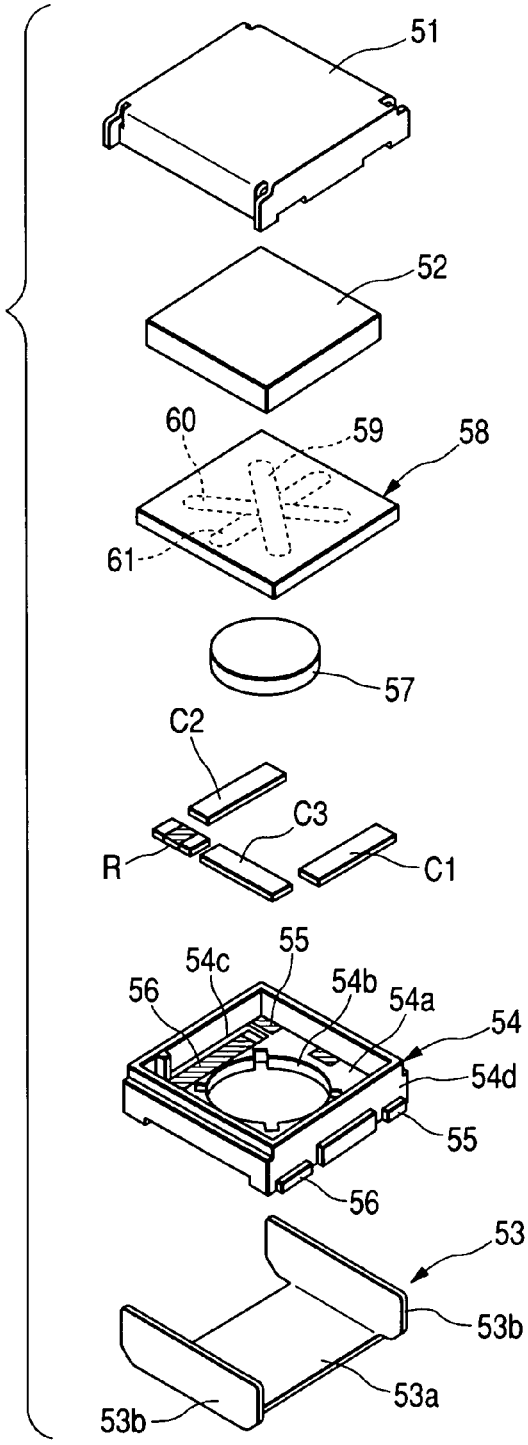
FIG. 12 PRIOR ART
FIG. 12 is an exploded perspective view of a conventional non-reciprocal circuit element.

Furthermore, FIG. 8 is a bottom view of the non-reciprocal circuit element according to the first embodiment of the present invention in a state in which a ground plate is attached to the dielectric; FIG. 9 is an enlarged cross-sectional view of essential parts of the non-reciprocal circuit element according to the first embodiment of the present invention in a state in which a capacitor is attached thereto; FIG. 10 is a bottom view of a non-reciprocal circuit element according to a second embodiment of the present invention in a state in which a central conductor is connected to a ground; and FIG. 11 is an exploded perspective view of a non-reciprocal circuit element according to a third embodiment of the present invention.

Next, a configuration in a case where the non-reciprocal circuit element of the present invention is applied to an isolator will be described with reference to FIGS. 1 to 9. A first yoke 1 made of a boxlike magnetic plate (iron plate or the like) has an upper plate 1*a* having a rectangular shape and two side plates 1*b* bent downward from two opposite sides of the upper plate 1*a*.

A rectangular magnet 2 is attached to the first yoke 1 by means of a suitable means such as an adhesive or the like in a state in which the magnet 2 is located within the boxlike first yoke 1 and in which a upper surface of the magnet 2 comes into contact with an inner surface of the upper plate 1*a*.

A second yoke 3 made of a magnetic plate (iron plate or the like) has a lower plate 3*a* having a rectangular shape, two side plates 3*b* bent upward from two opposite sides of the lower plate 3*a* and concave portions 3*c* provided along inner surfaces of the side plates 3*b*.

The second yoke 3 is integrally formed with a sidewall member 4 composed of an insulating member through a molding process. The sidewall member 4 includes sidewalls 4*a* provided between the two opposite side plates 3*b* and sidewalls 4*b* provided along the side plates 3*b* in a state in which the sidewalls 4*b* are located in the concave portions 3*c*. The sidewall member 4 has a rectangular shape as a whole.

A plurality of terminal plates 5 composed of metal plates is attached to the sidewalls 4*a* of the sidewall member 4 so as to be buried in the sidewalls 4*a*.

In addition, the first and second yokes 1 and 3 are coupled with each other to form a magnetic closed circuit.

A dielectric 6 is made of a laminated plate in which a plurality of insulating thin plates such as insulating films are laminated. At different laminated locations of the dielectric 6 that has a rectangular shape first to third central conductors 7, 8, and 9 that are made of a metal thin plate such as copper or a conductive film are formed. The first to third central conductors 7, 8, and 9 are disposed in a manner that parts of the first to third central conductors cross each other in a vertical direction via the dielectric 6.

In addition, as shown in FIGS. 5 to 7, in particular, the dielectric 6 includes three first through holes 6*a* provided so as to be located at corner portions of a triangle, a second through hole 6*b* provided between the two first through holes 6*a*, and a plurality of notch portions 6*c* provided at circumferences opposite to each other.

In addition, the first to third central conductors 7, 8, and 9 have ground portions 7*a*, 8*a*, and 9*a* at one end respectively, and the ground portions 7*a*, 8*a*, and 9*a* are provided to be exposed through the first through holes 6*a*.

In addition, the first to third central conductors 7, 8, and 9 have port portions 7*b*, 8*b*, and 9*b* at the other end respectively, and the port portions 7*b* and 8*b* are provided to be exposed through the notch portions 6*c* and the port portion 9*b* is provided to be exposed through the second through hole 6*b*.

In addition, on a bottom surface of the dielectric 6, first land portions 7*c*, 8*c*, and 9*c* which are connected to the port portions 7*b*, 8*b*, and 9*b* are provided, and the first land portions 7*c*, 8*c* and 9*c* are connected to connection conductors 10 which are provided at the locations of the notch portions 6*c* and the second through hole 6*b*.

In addition, another land portion 9*d* is provided near the first land portion 9*c*, a second land portion 9*e* is provided to correspond to the first through hole 6*a*, and the second land portion 9*e* is connected to the ground portion 9*a* of the third central conductor 9 and the connection conductor 10.

First to third capacitors C1, C2, and C3 are made of chip type capacitors and have an insulating body 11 and first and second electrodes 12*a* and 12*b* with the insulating body 11 interposed therebetween, respectively. As shown in FIGS. 6 and 7, first electrodes 12*a* located on the upper surfaces of the first to third capacitors C1, C2, and C3 are respectively soldered, connected and fixed to the first land portions 7*c*, 8*c*, and 9*c*. Further, one electrode 13*a* of a chip type resistor R is soldered, connected and fixed to the first land portions 9*c*, and the other electrode 13*b* of the resistor R is soldered, connected and fixed to the first land portions 9*d*.

A ground plate 14 made of one sheet of metal plate includes a base portion 14*b* having a flat plate shape with a hexagonal hole 14*a* formed at a center thereof, a plurality of protruding pieces 14*c* which protrude upward by cutting and bending parts of the base portion 14*b* from the inner circumference, and a plurality of flat tongue pieces 14*d* provided at front ends of outer circumferential portions by bending the outer circumferential portions of the base portion 14*b* upward in an L shape.

In addition, as shown in FIG. 8, in the ground plate 14, the tongue pieces 14*d* are respectively soldered, connected and fixed to the second electrodes 12*b* of the first to third capacitors C1, C2, and C3, the other electrode 13*b* of the resistor R and the second land portion 9*e*, and the protruding pieces 14*c* are connected to the connection conductors 10 in a state in which the protruding pieces 14*c* are located in the through holes 6*a* so as to be connected to the ground portions 7*a* and 8*a* of the first and second central conductors 7 and 8.

Further, the through holes 6*a* are used in the description of the present embodiment, but the present embodiment may use concave portions instead of the through holes 6*a*.

A ferrite member 15 which is made of YIG (Yttrium iron garnet) or the like and which has a flat plate shape such as a polygonal shape (a hexagonal shape) or the like is located in the hole 14*a* of the ground plate 14. In this state, the ferrite member 15 is accommodated in the second yoke 3 together with the ground plate 14 and the dielectric 6.

In this regard, a lower surface of the ferrite member 15 comes into contact with the lower plate 3*a* and the base portion 14*b* of the ground plate 14 comes into contact with the lower plate 3*a*. As a result, the ground portions 7*a*, 8*a*, and 9*a* of the first to third central conductors 7, 8, and 9, the second electrodes 12*b* of the first to third capacitors C1, C2, and C3 and the electrode 13*b* of the resistor R are connected to a ground.

At this time, the first and second electrodes 12*a* and 12*b* of the first to third capacitors C1, C2, and C3 and the electrodes 13*a* and 13*b* of the resistor R face the sidewalls 4*b* located at the side plate 3*b* side, so that they are electrically insulated with the side plates 3*b*.

In addition, the port portions 7*b* and 8*b* of the first and second central conductors 7 and 8 are soldered on the terminal plates 5.

In addition, in a state in which the magnet 2, the dielectric 6 and the ferrite member 15 are interposed between the first and second yokes 1 and 3, the first and second yokes 1 and 3 are coupled with each other to form the magnetic closed circuit, so that the non-reciprocal circuit element of the present invention is formed.

FIG. 10 shows a non-reciprocal circuit element according to a second embodiment of the present invention. The non-reciprocal circuit element according to the second embodiment is constructed such that the ground portion 9*a* of the third central conductor 9 is directly soldered to be connected to a ground between the second land portion 9*e* and the side plate 3*b*, without the connection of a ground and the ground portion 9*a* of the third central conductor 9 by means of the tongue piece 14*d* of the ground plate 14 as in the first embodiment.

Since the other configuration of the non-reciprocal circuit element according to the second embodiment is the same as that of the first embodiment, the same constituent elements as those of the first embodiment are denoted by the same reference numerals and a description thereof will be omitted.

FIG. 11 shows a non-reciprocal circuit element according to a third embodiment of the present invention. The non-reciprocal circuit element according to the third embodiment is constructed such that the base portion 14*b* of the ground plate 14 has a bottom, the ferrite member 15 is interposed between the base portion 14*b* having the bottom and the dielectric 6, the dielectric 6, the capacitors C1, C2, and C3, and the ground plate 14, and the ferrite member 15 are integrated with one assembly body, and the assembly body is assembled in the second yoke 3, without the hole 14*a* of the ground plate 14 as in the first embodiment.

Further, according to the third embodiment, the base portion 14*b* of the ground plate 14 comes into contact with the lower plate 3*a*. Since the other configuration of the non-reciprocal circuit element according to the third embodiment is the same as that of the first embodiment, the same constituent elements as those of the first embodiment are denoted by the same reference numerals and a description thereof will be omitted.

In addition, in the above-mentioned embodiments, the present invention is applied to the isolator. However, the present invention may be applied to the circulator in which the resistor R is removed.

What is claimed is:

1. A non-reciprocal circuit element comprising:

a first yoke having an upper plate;

a magnet disposed on a lower surface of the upper plate;

a second yoke which has a flat plate-shaped lower plate and which forms a magnetic closed circuit together with the first yoke;

a flat plate-shaped ferrite member disposed on the lower plate;

a flat plate-shaped dielectric disposed on the ferrite member between the magnet and the ferrite member and which is made of a laminated plate having a plurality of laminated insulating thin plates;

first to third central conductors which are formed at different laminated locations of the dielectric and which are disposed in a manner that parts of the first to third central conductors cross each other in a vertical direction; and a plurality of capacitors each having first and second electrodes opposite to each other with an insulating body interposed therebetween, wherein the capacitors are disposed on a bottom surface of the dielectric facing the ferrite member in a state in which the first electrodes are connected to port portions serving as one end of the central conductors, and the second electrodes of the capacitors and ground portions serving as the other ends of the central conductors are connected to a ground plate composed of one sheet of metal plate and the ground plate is connected to the lower plate of the second yoke.

2. The non-reciprocal circuit element according to claim 1, wherein on the bottom surface of the dielectric, first land portions connected to the port portions of the central conductors are provided, and the first electrodes are connected to the first land portions.

3. The non-reciprocal circuit element according to claim 1, wherein the ground plate has a flat plate-shaped base portion and protruding pieces protruding upward from the base portion, the base portion is disposed on the lower plate, and the protruding pieces are connected to the ground portions of the central conductors.

4. The non-reciprocal circuit element according to claim 3, wherein the ground portions of the central conductors lead into through holes or concave portions provided in the dielectric by means of connection conductors, the protruding pieces are connected to the connection conductors in a state in which the protruding pieces are located in the through holes or concave portions.

5. The non-reciprocal circuit element according to claim 3, wherein the ground plate has flat plate-shaped tongue pieces which are formed to be bent from outer circumferential portions of the base portion toward the dielectric and which are arranged parallel to the bottom surface of the dielectric, and, the tongue pieces are connected to the second electrodes.

6. The non-reciprocal circuit element according to claim 3, wherein a hole is formed in a central portion of the base portion of the ground plate, and the ferrite member is disposed on the lower plate through the hole.

7. The non-reciprocal circuit element according to claim 3, wherein the ferrite member is disposed on the flat plate-shaped base portion of the ground plate, the ferrite member is interposed between the dielectric and the ground plate, and the ferrite member is connected to the lower plate through the base portion of the ground plate.

8. The non-reciprocal circuit element according to claim 1, wherein the second yoke is integrally formed with a sidewall member composed of an insulating member by means of a molding process, terminal plates are buried in the sidewall member, and the port portions of the central conductors are connected to the terminal plates.

9. The non-reciprocal circuit element according to claim 8, wherein the second yoke has a lower plate, side plates bent upward from a lower plate and concave portions provided in the side plates, a part of the sidewall member is provided in the concave portions, the sidewall member located in the concave portions provided along the side plates is opposite to the electrodes of the capacitors, and the electrodes are electrically insulated from the side plates through the sidewall member.

* * * * *